US009192271B2

(12) United States Patent
Dekkers et al.

(10) Patent No.: US 9,192,271 B2
(45) Date of Patent: Nov. 24, 2015

(54) SUCTION UNIT AND AUTONOMOUS VACUUM CLEANER

(75) Inventors: Jeroen Dekkers, Eindhoven (NL); Theo Anjes Maria Ruijl, Eindhoven (NL); Silvester Matheus Reijnders, Eindhoven (NL); Jan Van Eijk, Eindhoven (NL); Hubert Gerard Jean Joseph Amaury Vroomen, Eindhoven (NL); Thomas Petrus Hendricus Warmerdam, Eindhoven (NL); Robertus Mathijs Gerardus Rijs, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 1479 days.

(21) Appl. No.: 12/673,196

(22) PCT Filed: Aug. 18, 2008

(86) PCT No.: PCT/IB2008/053304

§ 371 (c)(1),
(2), (4) Date: Jun. 20, 2011

(87) PCT Pub. No.: WO2009/024917

PCT Pub. Date: Feb. 26, 2009

(65) Prior Publication Data

US 2011/0239397 A1 Oct. 6, 2011

(30) Foreign Application Priority Data

Aug. 21, 2007 (EP) ..... 07114669

(51) Int. Cl.
*A47L 9/02* (2006.01)
*A47L 9/00* (2006.01)

(Continued)

(52) U.S. Cl.
CPC . *A47L 9/02* (2013.01); *A47L 9/009* (2013.01); *A47L 9/0072* (2013.01); *A47L 9/2821* (2013.01); *A47L 5/04* (2013.01); *A47L 2201/00* (2013.01)

(58) Field of Classification Search
CPC ..... A47L 9/0477; A47L 9/0411; A47L 5/30; A47L 9/04; A47L 5/34
USPC ..... 15/319, 357, 354, 383, 345, 411
See application file for complete search history.

(56) References Cited

U.S. PATENT DOCUMENTS 1,519,192 A * 12/1924 Dempsey ..... 15/319
5,815,880 A * 10/1998 Nakanishi ..... 15/319

(Continued)

FOREIGN PATENT DOCUMENTS

CN 1889880 A 1/2007
EP 0803224 A2 10/1997

(Continued)

*Primary Examiner* — Robert Scruggs

(57) ABSTRACT

The invention relates to a suction unit and relates to a vacuum cleaner. The suction unit comprises a drive system for driving the suction unit over a surface to be treated; a chassis supporting the drive system; a nozzle for removing particles from a surface to be treated which nozzle is configured to move with relation to the chassis in a direction away from the surface to be treated, the nozzle having an interior space defining an opening that faces the surface to be treated; and an outlet communicating with the interior space, the outlet being arranged for communication with a fan unit in operating conditions. The suction unit further comprises coupling means for coupling the nozzle to the chassis, wherein the coupling means is arranged to exert a force that is directed away from the surface to be treated when the under pressure in the interior space increases. In this manner the problem of the suction unit getting stuck on the floor can be overcome or at least be reduced. Furthermore the traction of the drive system can be improved. An autonomous vacuum cleaner according to the invention comprises such a suction unit and further comprises a dust chamber, and a fan unit that communicates with the dust chamber, the fan unit communicating with the outlet for creating under pressure in the interior space of the nozzle in operating conditions.

17 Claims, 2 Drawing Sheets

(51) Int. Cl.
*A47L 9/28* (2006.01)
*A47L 5/04* (2006.01)

(56) References Cited

U.S. PATENT DOCUMENTS

| | | | | |
|---|---|---|---|---|
| 7,200,892 | B2 | 4/2007 | Kim | |
| 7,599,758 | B2 * | 10/2009 | Reindle et al. | 700/258 |
| 7,673,367 | B2 * | 3/2010 | Kim et al. | 15/319 |
| 2006/0010640 | A1 | 1/2006 | Oka | |
| 2006/0085095 | A1 | 4/2006 | Reindle | |
| 2006/0253224 | A1 | 11/2006 | Tani et al. | |

FOREIGN PATENT DOCUMENTS

| | | | |
|---|---|---|---|
| EP | 1695770 | A1 | 8/2006 |
| GB | 392871 | A | 1/1933 |
| GB | 2285740 | A | 7/1995 |
| JP | 6292646 | A | 4/1994 |
| JP | 7000320 | A | 1/1995 |
| JP | 7079890 | A | 3/1995 |
| JP | 8275913 | A | 10/1996 |
| JP | 2007512884 | A | 5/2007 |
| KR | 2000002305 | A | 1/2000 |
| WO | 02074150 | A1 | 9/2002 |
| WO | 2005087074 | A1 | 9/2005 |

* cited by examiner

SUCTION UNIT AND AUTONOMOUS VACUUM CLEANER

FIELD OF THE INVENTION

The present invention relates to a suction unit for an autonomous vacuum cleaner. Furthermore the invention relates to an autonomous vacuum cleaner.

BACKGROUND OF THE INVENTION

In EP0803224 a suction unit is integrated with a fan unit and a dust chamber, while all components are accommodated in the same housing. In EP0803224 the outlet of the nozzle for removing particles from a surface to be treated communicates with a chamber accommodating a dust container. The chamber is connected to a fan unit that provides under pressure. The nozzle is mounted to the chassis by an arm that is supported by a ball joint so that it can pivot with relation to the housing. During movement of the vacuum cleaner across the floor the nozzle rests by its own weight on the floor and floats on the floor because of the flexible support at the ball joint.

A problem with known suction units is that when the nozzle is completely sealed from the outside atmosphere the under pressure in the nozzle increases while the nozzle gets stuck on the surface to be treated. This occurs especially when cleaning soft floors such as carpets. The problem is already well known for traditional non-autonomous vacuum cleaners. For autonomous vacuum cleaners the consequences generally are worse, since it can lead to a device that gets inoperable, without a user noticing it. The enhanced under pressure results in a normal force that presses the nozzle down to the cleaning surface. It could then occur that the driving system has insufficient power to move the suction unit or vacuum cleaner to overcome the increased downward force. This can result in the device getting immobile. This is in particular true when the suction unit is relatively small, since in that case a drive system normally will only have limited power.

SUMMARY OF THE INVENTION

It is an object of the present invention to provide a suction unit that reduces the abovementioned disadvantage.

Accordingly the present invention provides an autonomous suction unit comprising;

a drive system for driving the suction unit over a surface to be treated; a chassis supporting the drive system;

a nozzle for removing particles from a surface to be treated, which nozzle is configured to move with relation to the chassis in a direction away from the surface to be treated, the nozzle having an interior space defining an opening that faces the surface to be treated in operating conditions;

an outlet communicating with the interior space, the outlet being arranged for communication with a fan unit in operating conditions;

wherein the suction unit further comprises coupling means for coupling the nozzle to the chassis, and wherein the coupling means are arranged to exert a force that is directed away from the surface to be treated when the under pressure in the interior space increases.

With this suction unit the problem of restricted mobility is avoided or at least reduced by the coupling means that exert a force away from the surface to be treated whenever the under pressure in the interior space of the nozzle increases. If the nozzle gets stuck the under pressure in the interior space will increase due to the opening that is sealed from the environment. This results in an increased normal force working on the nozzle. This force will at least partially be reduced by the coupling means that will exert a counter force away from the surface to be treated.

Any enhanced downward force on the nozzle due to increasing pressure therein can effectively be reduced in this manner while driving the suction unit gets easier. An additional advantage is that the force exerted by the coupling means results in improved traction force of the driving system on the surface to be treated as the force exerted by the coupling means will be transferred in increased downward force acting on the chassis. This will be explained in more detail below.

According to a preferred embodiment the coupling means comprises a bellows interposed between the chassis and the nozzle, the bellows having an interior space that communicates with the interior space of the nozzle. This provides a simple and effective construction for the coupling means. When the under pressure in the nozzle increases the under pressure in the bellows will also increase. Or in other words the pressure in the bellows drops. Accordingly the bellows will contract and exert a counter force on the nozzle that is directed away from the surface to be treated. A larger under pressure in the nozzle results in a larger under pressure in the bellows and with that in a larger force that is exerted on the nozzle.

Another simple and effective construction is the suction unit wherein the coupling means comprises a piston and a cylinder assembly interposed between the chassis and the nozzle, the cylinder space having an interior space that communicates with the interior space of the nozzle.

According to another preferred embodiment the coupling means comprises a linear actuator interposed between the chassis and the nozzle for moving the nozzle with relation to the chassis in a substantially vertical direction. It is especially preferred if a pressure sensor is provided in the interior space, the sensor giving an output signal, the linear actuator being configured to move the nozzle depending on the output signal of the pressure sensor. This has the advantage that the force that is exerted on the nozzle can be arranged in an active manner, which results in a precise control of the forces working on the nozzle.

Furthermore it is preferred when the coupling means comprises an arm that is pivotally mounted to the chassis by means of a pivot axis and extends substantially parallel with relation to the surface to be treated, the nozzle being supported by the arm. This provides a simple and effective construction. It is especially preferred when the nozzle is provided at a front part of the chassis and the pivot axis is provided at a rear part of the chassis, the pivot axis being provided at a low point of the chassis so the distance between the pivot axis and the surface to be treated in operating conditions is small. This embodiment ensures that the arm extending between the nozzle and the pivot axis is relatively long. In combination with the fact that the pivot axis is close to a surface to be treated results that a friction force acting on a forward moving nozzle leads to a relatively small (downward) normal force acting on the nozzle. Favourable distances and dimensions are a distance between the pivot point and the surface to be treated in operating conditions of between 25-40 mm, more preferably between 30-35 mm, and a length of the arm of between 150-180 mm, more preferably between 165-175 mm. This will be explained in more detail below.

According to another preferred embodiment the drive system comprises a set of wheels provided at opposite sides of the chassis, and wherein the wheels on either side of the chassis can be separately operated. This allows to easily turn the suction unit by driving the wheels at one side of the chassis only.

The present invention also relates to an autonomous vacuum cleaner comprising a suction unit according to any one of the aforementioned embodiments, the vacuum cleaner further comprising a dust chamber, and a fan unit that communicates with the dust chamber, the fan unit communicating with the outlet for creating under pressure in the interior space of the nozzle in operating conditions. Preferred embodiments include an automomous vacuum cleaner wherein:

- a main unit accommodating a dust chamber and a fan unit is provided, the main unit comprising a drive system for driving the main unit over a surface to be treated and being connected to a suction unit by a hose assembly;
- a main unit comprises a mapping system for mapping an area to be treated and a planning system for planning a cleaning operation, the planning system controlling the drive system; and
- a suction unit, a dust chamber and a fan unit are accommodated in a unitary housing, the housing being mounted to the chassis.

The present invention is in particular advantageous to be used for the arrangement as described in WO 02/074150. This document discloses an autonomous cleaner having a self propelling moving suction unit or cleaning head that is connected to a main module or vacuum fan module that is also self propelling and holds a dust container and a fan unit as well as the larger part of the cleaner' navigation and control system. Because the size of the suction unit is relatively low, at least compared to the main module, the maximum power of the drive system therein will be relatively low. Since the suction power generated in the main module typically will be equal to conventional vacuum cleaners, there is an enhanced risk to the suction unit getting stuck on the floor. The maximum power of the drive system then can be insufficient to overcome this. Moreover the weight of such a suction unit will be relatively low. Accordingly the normal force acting on the wheels is relatively low which leads to an enhanced risk of spinning wheels.

The present invention can also be applied in an integrated autonomous vacuum cleaner wherein a main unit accommodating a dust chamber and a fan unit is provided, the main unit comprising a drive system for driving the main unit over a surface to be treated and being connected to a suction unit by a hose assembly. EP0803224 describes an integrated autonomous vacuum cleaner. In these vacuum cleaners all components are integrated in a unitary self propelling unit.

The term 'bellows' within this specification is used to indicate any deformable container having at least one opening that is able to expand or contract when the pressure in the container respectively increases or decreases.

BRIEF DESCRIPTION OF THE DRAWINGS

Embodiments of the present invention will now be described by way of example and with reference to the accompanying drawing, wherein.

DETAILED DESCRIPTION OF EMBODIMENTS

Figure 1:
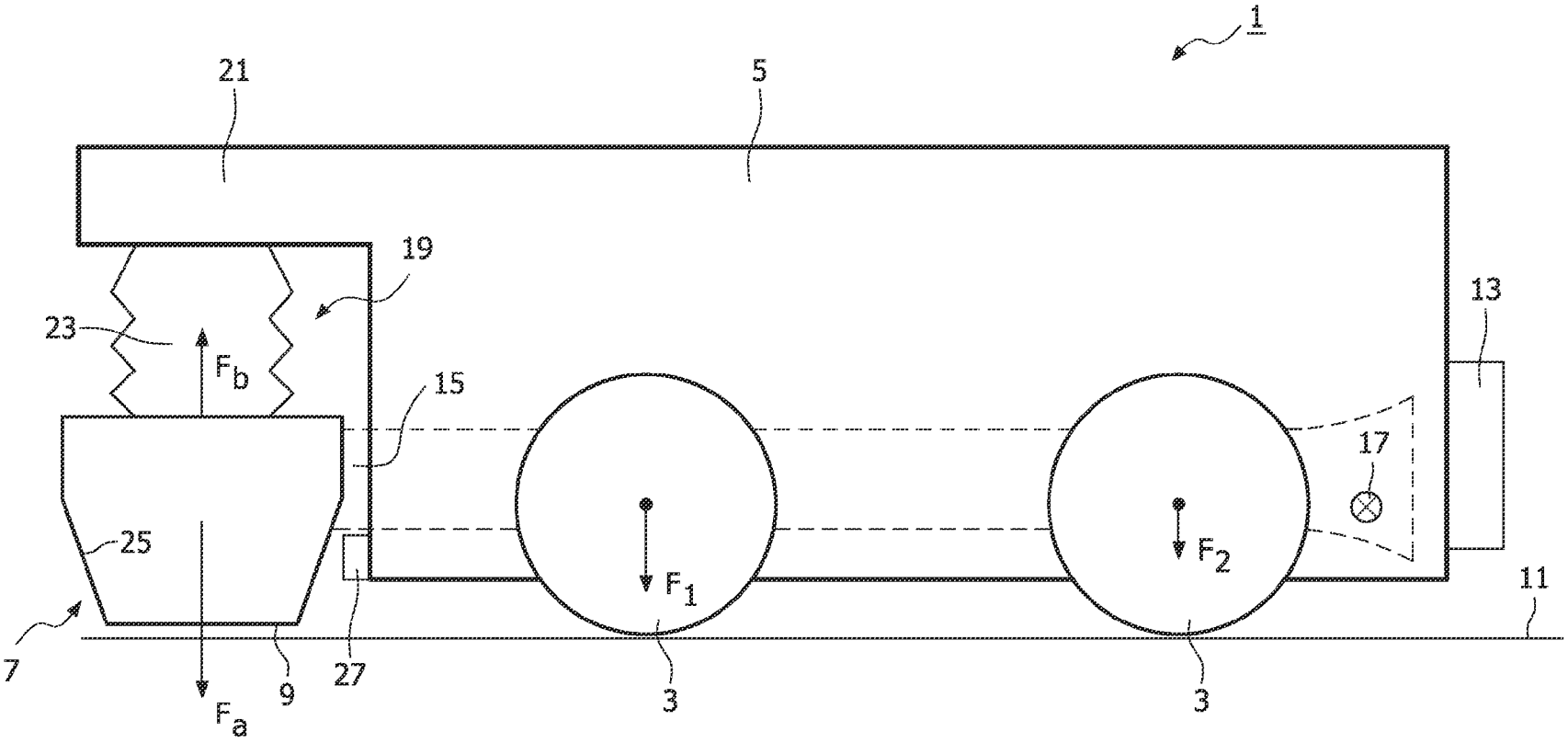
FIG. 1 shows a schematic side view of a suction unit.

FIG. 1 shows a suction unit 1 according to a preferred embodiment of the present invention. The suction unit has a drive system that comprises wheels. In this embodiment two sets of wheels 3 are provided on each side. Both wheels on either side can be separately operated in order to turn the suction unit. Two electromotors, one on each side, are provided to drive the wheels. Preferably, each wheel on the chassis is driven by the motor. Preferably a set of gears (not shown) are interposed between the wheels and an electromotor. The wheels are carried by a chassis 5. Several other parts are also mounted to the chassis.

At a front part of the chassis a nozzle 7 is provided. The nozzle has an interior space defining an opening 9 facing the surface to be treated 11 when the suction unit is operational. The interior space communicates with an outlet 13, while at another side it results in the opening 9. The outlet 13 is meant to communicate with suction means or a fan unit when the suction unit is operated. One can for example connect a hose assembly at one side to the outlet at while the other side is connected to a unit accommodating a dust chamber and a fan unit. By operating the fan unit an under pressure arises in the interior space of the nozzle which enables picking up particles and dust from the surface 11 to be cleaned.

Alternatively a fan unit and for example a dust bin and a filter element may be provided in one unitary housing accommodating all components of the vacuum cleaner.

The nozzle is carried by an arm 15 that is pivotable with relation to the chassis 5 around a pivot axis 17. The arm 15 extends in the chassis which is indicated with dotted lines. The pivot axis preferably lies behind both wheels at a rear part of the chassis. The arm preferably also accommodates the air path that establishes the communication between the nozzle and the outlet. The air path can be formed by a tube or a hose or a combination thereof.

The opening 9 or lower edge of the nozzle 7 normally rests a few millimeters above the surface 11. This allows for surrounding air being sucked into the nozzle and thus for picking up dust particles. In case of hard floors this condition is always satisfied. In case of soft floors however a nozzle can be scaled, for example by numerous fibers, from the surrounding air. When this takes place the pressure in the interior space of the nozzle drops while ambient air pressure presses the nozzle down.

A bellows 19 is interposed between an extension 21 of the chassis 5 and the nozzle 7. The bellows has an interior part 23 that communicates with the interior part of the nozzle via one or more openings (not shown) that are provided in a plate between both parts. The plate may also be an integral part of the bellows 19.

Due to the aforementioned openings the under pressure in the interior space of the bellows will increase whenever the under pressure in the interior space of the bellows will increase. Like mentioned above this mainly occurs when the nozzle rests in a soft floor with fibers that largely shut off the nozzle from the ambient air. Due to the action of a fan unit the pressure of the air surrounding the nozzle will be larger than the pressure in the nozzle which presses the nozzle down. In the drawing this is indicated by force $F_a$. When the under pressure in the bellows increases it will contract. Upon contracting the bellows exerts a counter force $F_b$ on the nozzle that is directed away from the surface to be treated. This force reduces the total normal force acting on the nozzle and thus reduces the sealing action of the nozzle. In this manner a new balance will automatically be established wherein the force that is exerted by the bellows compensates or at least partly compensates the downward force on the nozzle. Hence the problem of the nozzle getting stuck to the surface is restricted.

The counter force $F_b$ leads to an improved traction of the wheels. As the bellows is attached to an extension 21 of the chassis 5 the force generated by the bellows will lead to a counter force acting on the chassis, which ultimately via the 'action is minus reaction principle' leads to an increased normal force acting on wheels 3. In FIG. 1 this is indicated by downward forces $F_1$ and $F_2$. The force $F_1$ acting on the front wheels, or the wheels closest to the nozzle, will be somewhat higher than the force $F_2$ working on the back wheels, due to the geometry of the suction unit.

The nozzle and the chassis may be accommodated in a housing, which is not shown in FIG. 1 The chassis and a housing may be integrated in a unitary part. Furthermore the suction unit may be provided with cameras for navigation purposes. Next to a hose assembly the suction unit may be connected by electrical wires to a unit accommodating a fan unit. Preferably the electrical wires are integrated with the hose assembly. Alternatively or additionally a wireless connection between both units may be provided.

The magnitude of the force that is exerted on the nozzle by the bellows will mainly depend on the ratio between the area of the nozzle opening and the cross-sectional area of the bellows. Enlarging the effective area of the bellows in relation to the cross-sectional area of the nozzle leads to a larger counter force acting on the nozzle.

Figure 2:
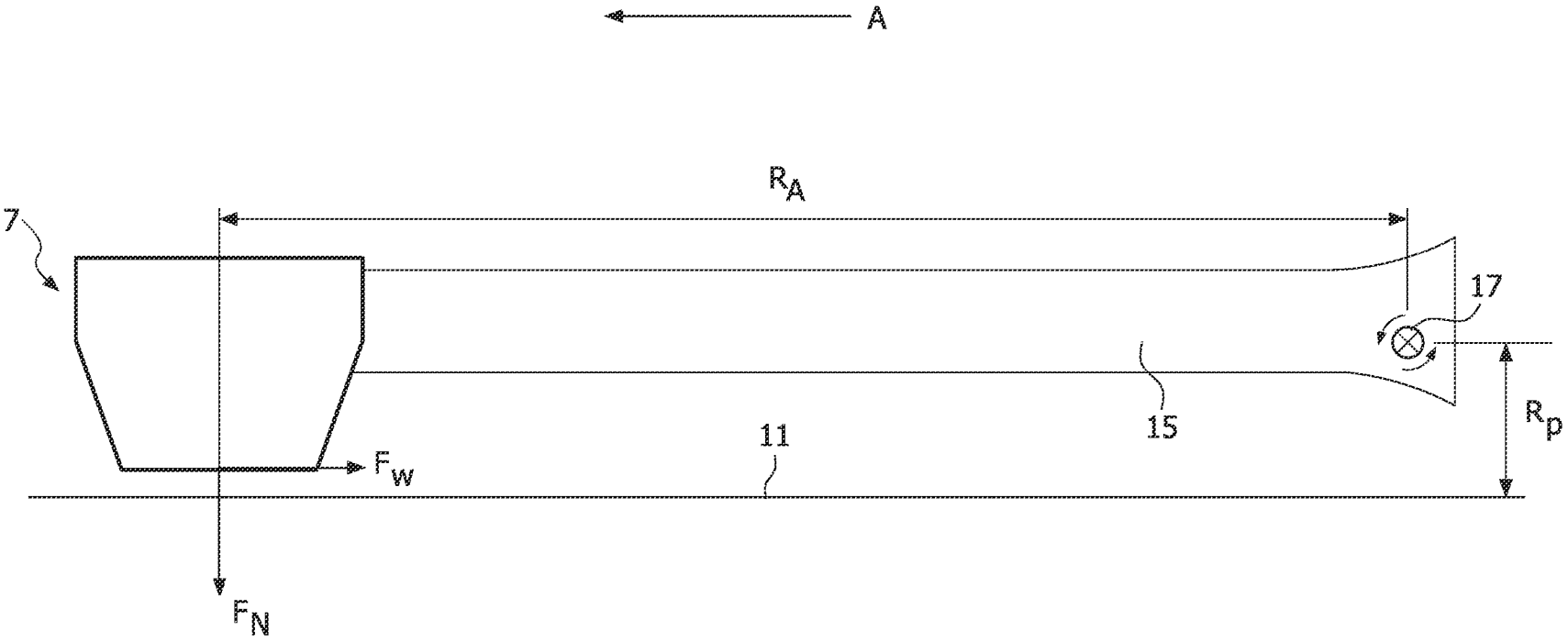
FIG. 2 only shows a nozzle, an arm and a pivot axis of the suction unit in FIG. 1.

FIG. 2 only shows the pivot axis 17, the arm 15 and the nozzle 7 of the suction unit shown in FIG. 1. FIG. 2 is meant to indicate moments acting around the pivot axis due to a friction force on the nozzle. When the suction unit moves forward, indicated with arrow A, a friction force $F_w$ will act on the nozzle. The distance between the pivot axis 17 and the surface to be treated is $R_p$. The friction force leads to a moment $M_1$ having arm $R_p$ and a counter moment $M_2$ around the pivot axis. The counter moment $M_2$ corresponds to a normal force $F_n$ acting on the nozzle and has an arm $R_a$. With relation to $M_1$ and $M_2$ it holds;

$$F_w \times R_p = F_n \times R_a$$

Therefore having an arm that is relatively long and keeping the distance $R_p$ relatively low, the resulting normal force acting on the nozzle will be relatively low. A relatively long arm is obtained by providing the nozzle at a front part of the chassis and providing the pivot axis at a rear part of the chassis. Keeping distance RP relatively low is obtained by providing the pivot axis at a low point of the chassis.

Preferably a rotating brush is provided in the interior space of the nozzle, which brush is driven by an electromotor provided behind the nozzle.

Instead of the pivoting arm the nozzle may also be arranged to move with relation to the chassis by means of guiding means, such as roller bearings provided at one or more sides of the nozzle facing the chassis.

It will be clear to a person skilled in the art that the scope of the present invention is not limited to the examples discussed in the foregoing, but that several amendments and modifications thereof are possible without deviating from the scope of the present invention as defined in the attached claims. While the present invention has been illustrated and described in detail in the figures and the description, such illustration and description are to be considered illustrative or exemplary only, and not restrictive. The present invention is not limited to the disclosed embodiments. Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the present invention.

The invention relates to a suction unit for a vacuum cleaner and relates to a vacuum cleaner. The suction unit comprises a drive system for driving the suction unit over a surface to be treated; a chassis supporting the drive system; a nozzle for removing particles from a surface to be treated which nozzle is configured to move with relation to the chassis in a direction away from the surface to be treated, the nozzle having an interior space defining an opening facing the surface to be treated; and an outlet communicating with the interior space, the outlet being arranged for communication with a fan unit in operating conditions. The suction unit further comprises coupling means for coupling the nozzle to the chassis, wherein the coupling means are arranged to exert a force that is directed away from the surface to be treated when the under pressure in the interior space increases. In this manner the problem of the suction unit getting stuck on the floor can be overcome or at least be reduced. Furthermore the traction of the drive system can be improved. An autonomous vacuum cleaner according to the invention comprises such a suction unit and further comprises a dust chamber, and a fan unit that communicates with the dust chamber, the fan unit communicating with the outlet for creating under pressure in the interior space of the nozzle in operating conditions.

The invention claimed is:

1. A suction unit for a self-driven vacuum cleaner, said suction unit comprising:

a drive system including at least first and second drive members for moving the suction unit on a surface to be treated;

a chassis supporting the drive system;

a nozzle for removing matter from the surface to be treated, said nozzle having an opening that faces the surface to be treated during operation and an interior space in communication with said opening;

an outlet in communication with the interior space of the nozzle via a coupling device, said outlet being arranged for communication with a fan unit for effecting airflow through the suction unit during operation;

the coupling device being arranged between the nozzle and the chassis for movably coupling the nozzle to the chassis for motion in directions toward and away from the surface to be treated, said coupling device being adapted, in direct response to the occurrence of a reduction of air pressure in the interior space of the nozzle that is indicative of a reduced airflow through the nozzle, to simultaneously produce a force for moving the nozzle away from the surface to be treated and a counter force for moving the chassis and the at least first and second drive members toward said surface to be treated, said force and simultaneous counter force, respectively, operating to prevent a movement-stopping seal from developing between the nozzle and the surface to be treated and to increase traction of the at least first and second drive members, thereby assisting the self-driven movement of the suction unit.

2. The suction unit according to claim 1, wherein the coupling device comprises a bellows interposed between the chassis and the nozzle, the bellows having an interior space that communicates with the interior space of the nozzle, said reduction of pressure causing a decrease in the volume of said bellows interior space and thereby producing said force.

3. The suction unit according to claim 1, wherein the coupling device comprises a piston and a cylinder assembly interposed between the chassis and the nozzle, the cylinder having an interior space that communicates with the interior space of the nozzle.

4. The suction unit according to claim 1, wherein the coupling device comprises an actuator interposed between the chassis and the nozzle for moving the nozzle relative to the chassis in a substantially vertical direction.

5. The suction unit according to claim 4 and including a control unit and a pressure sensor provided in the interior space of the nozzle, the sensor giving a signal to the control unit depending on the pressure in the interior space, the control unit controlling the actuator depending on the signal from the pressure sensor.

6. The suction unit according to claim 1, wherein the at least first and second drive members comprise a set of wheels provided at opposite sides of the chassis, and wherein the wheels on either side of the chassis can be separately operated.

7. The suction unit according to claim 1 where the coupling device comprises a variable-volume chamber attached at opposite ends to the chassis and the nozzle, respectively, and having an interior space in communication with the interior space of the nozzle, said reduction of pressure causing the chamber to contract and force the nozzle and the chassis toward each other.

8. A suction unit for a self-driven vacuum cleaner, said suction unit comprising:

a drive system including at least first and second drive members for moving the suction unit on a surface to be treated;

a chassis supporting the drive system;

a nozzle for removing matter from the surface to be treated, said nozzle having an opening that faces the surface to be treated during an operation and an interior space in communication with said opening;

an outlet in communication with the interior space of the nozzle, said outlet being arranged for communication with a fan unit for effecting airflow through the suction unit during operation; and a coupling device arranged between the nozzle and the chassis for movably coupling the nozzle to the chassis for motion in directions toward and away from the surface to be treated, said coupling device being adapted, in response to the occurrence of a reduction of air pressure in the interior space of the nozzle that is indicative of a reduced airflow through the nozzle, to simultaneously produce a force for moving the nozzle away from the surface to be treated and a counter force for moving the chassis and the at least first and second drive members toward said surface to be treated, said force and simultaneous counter force, respectively, operating to prevent a movement-stopping seal from developing between the nozzle and the surface to be treated and to increase traction of the at least first and second drive members, thereby assisting movement of the suction unit;

wherein the coupling device further comprises an arm that is pivotally mounted to the chassis at a pivot point and extends substantially parallel with relation to the surface to be treated, the nozzle being supported by the arm.

9. The suction unit according to claim 8, wherein the nozzle is disposed at a front part of the chassis and the pivot point is disposed at a rear part of the chassis, the pivot point being low on the chassis, so that the distance between the pivot point and the surface to be treated during operation is small in relation to the distance from the pivot point to the nozzle.

10. The suction unit according to claim 8, wherein the distance between the pivot point and the surface to be treated during operation is between 25 and 40 mm.

11. The suction unit according to claim 8, wherein the length of the arm is between 150 and 180 mm.

12. The suction unit according to claim 8, wherein the distance between the pivot point and the surface to be treated during operation is between 30 and 35 mm.

13. The suction unit according to claim 8, wherein the length of the arm is between 165 and 175 mm.

14. An autonomous vacuum cleaner comprising:

a suction unit including:

a drive system including at least first and second drive members for moving the vacuum cleaner on a surface to be treated;

a chassis supporting the drive system;

a nozzle for removing matter from the surface to be treated, said nozzle having an opening that faces the surface to be treated during operation and an interior space in communication with said opening;

an outlet in communication with the interior space of the nozzle via a coupling device, said outlet being arranged for communication with a fan unit for effecting airflow through the suction unit during operation;

the coupling device being arranged between the nozzle and the chassis for movably coupling the nozzle to the chassis for motion in directions toward and away from the surface to be treated, said coupling device being adapted, in direct response to the occurrence of a reduction of air pressure in the interior space of the nozzle that is indicative of a reduced airflow through the nozzle, to simultaneously produce a force for moving the nozzle away from the surface to be treated and a counter force for moving the chassis and the at least first and second drive members toward said surface to be treated, said force and simultaneous counter force, respectively, operating to prevent a movement-stopping seal from developing between the nozzle and the surface to be treated and to increase traction of the at least first and second drive members, thereby assisting said movement of the vacuum cleaner;

a dust chamber in communication with the fan unit for receiving the matter; and the fan unit.

15. The autonomous vacuum cleaner according to claim 14, wherein a main unit accommodating the dust chamber and the fan unit is provided, the main unit including the drive system and being connected to the suction unit by a hose assembly.

16. The autonomous vacuum cleaner according to claim 15, wherein the main unit comprises a mapping system for mapping an area to be treated and a planning system for planning a cleaning operation, the planning system controlling the drive system.

17. The autonomous vacuum cleaner according to claim 14, wherein the suction unit, the dust chamber and the fan unit are accommodated in a unitary housing, the housing being mounted to the chassis.

* * * * *